US007051487B2

(12) United States Patent
Jones

(10) Patent No.: US 7,051,487 B2
(45) Date of Patent: May 30, 2006

(54) CONSERVATORY STRUCTURES

(75) Inventor: Dennis Anthony Jones, Nantwich (GB)

(73) Assignee: Wrenbury Hall Limited, Nantwich (GB)

( * ) Notice: Subject to any disclaimer, the term of this patent is extended or adjusted under 35 U.S.C. 154(b) by 0 days.

(21) Appl. No.: 10/656,410

(22) Filed: Sep. 5, 2003

(65) Prior Publication Data

US 2004/0045228 A1 Mar. 11, 2004

(30) Foreign Application Priority Data

| | | |
|---|---|---|
| Sep. 6, 2002 | (GB) | 0220704 |
| Nov. 19, 2002 | (GB) | 0226895 |
| Feb. 25, 2003 | (GB) | 0304186 |
| May 28, 2003 | (GB) | 0312157 |

(51) Int. Cl.
*E04B 1/32* (2006.01)
*E04B 7/08* (2006.01)

(52) U.S. Cl. ..... 52/640; 52/90.1; 52/461; 52/465; 52/469; 52/646; 52/655.1; 52/DIG. 17

(58) Field of Classification Search ..... 52/734.2, 52/204.71, 90.1, 46 J, DIG. 17, 91.1, 92.1, 52/92.3, 93.2, 460, 461, 639, 640, 655.1
See application file for complete search history.

(56) References Cited

U.S. PATENT DOCUMENTS 4,673,308 A 6/1987 Reilly (Continued)

FOREIGN PATENT DOCUMENTS

DE 9115826.5 5/1992

(Continued)

OTHER PUBLICATIONS

U.S. Appl. No. 10/209,501, filed Jul. 31, 2002, Dennis Anthony Jones.

*Primary Examiner*—Carl D. Friedman
*Assistant Examiner*—Yvonne M. Horton
(74) *Attorney, Agent, or Firm*—Bracewell & Giuliani LLP

(57) ABSTRACT

A conservatory framework has an eaves structure from which the roof is supported, at least one comer and/or in-line joint in the eaves structure being two connector parts which are angularly adjustable relative to one another. The first and second elongate frame members, e.g. a hip bar and jack rafter, are coupled together in angular relation relative to one another by a coupling arrangement. The coupling arrangement includes a plate with an upstanding pivot post, a channel associated with and extending longitudinally of the first frame member for receiving the plate and maintaining it captive against separation from the first member in a direction generally transverse to its elongation, and an arm adapted to be coupled to the pivot post and to the second frame member. A roofing structure has a support structure, e.g. an eaves beam or the central support structure of a valley region of the roof, glazing bars supported on the eaves structure, one or more roofing panels supported by the glazing bars and two part end fittings. Each fitting has a first portion underlying one end of the roofing panel and coupled to the eaves structure and a second portion connectable to the first portion in overlying relation with the panel. The first and second portions are adjustably connected together so as to accommodate panels of different thicknesses.

17 Claims, 10 Drawing Sheets

U.S. PATENT DOCUMENTS

| | | | | |
|---|---|---|---|---|
| 5,515,941 | A | 5/1996 | Palmer et al. | |
| 5,678,383 | A | 10/1997 | Danielewicz | |
| 5,826,380 | A * | 10/1998 | Wolfe | 52/90.1 |
| 5,878,802 | A | 3/1999 | Richter et al. | |
| 5,937,590 | A * | 8/1999 | Richardson | 52/90.1 |
| 6,000,176 | A * | 12/1999 | Lancaster | 52/198 |
| 6,112,493 | A * | 9/2000 | Rickman | 52/640 |
| 6,223,481 | B1 * | 5/2001 | Rickman | 52/90.1 |
| 6,318,047 | B1 * | 11/2001 | Richardson | 52/734.2 |
| 6,553,739 | B1 * | 4/2003 | Richardson | 52/734.2 |
| 2002/0110406 | A1 | 8/2002 | Coles | |

FOREIGN PATENT DOCUMENTS

| | | | |
|---|---|---|---|
| EP | 0989250 | A1 | 3/2000 |
| GB | 2081355 | A | 2/1982 |
| GB | 2247474 | A | 3/1992 |
| GB | 2256880 | A | 12/1992 |
| GB | 2323107 | A | 9/1998 |
| GB | 2378207 | A | 2/2003 |
| GB | 2378478 | A | 2/2003 |

* cited by examiner

CONSERVATORY STRUCTURES

CROSS-REFERENCE TO RELATED APPLICATION

This application claims the benefit of United Kingdom Patent Application Nos. 0220704.1, filed on Sep. 6, 2002; 0226895.1, filed on Nov. 19, 2002; 0304186.0, filed on Feb. 25, 2003; and 0312157.1, filed on May 28, 2003, which hereby is incorporated by reference in its entirety.

TECHNICAL FIELD OF THE INVENTION

The present invention relates to improvements in roof structures and components, especially for conservatories. Other aspects of the invention are concerned with structural features of conservatories.

BACKGROUND OF THE INVENTION

A first aspect of this invention relates to the construction of conservatories of the type in which glazed window frames are provided between an eaves beam and a sill, the eaves beam and the sill being in the form of extruded profiles, e.g. of a metal such as aluminium or aluminium alloy or of a plastics material.

One of the problems associated with the fabrication of such conservatories lies in the cutting of the extruded profiles to form comer joints. This is generally done by mitring of adjacent sections of the extruded profile. To ensure accuracy, the cutting is often done off-site (e.g. at factory premises) and the previously mitred profiles are then transported to the erection site. Another problem is the variation in the angles that may be required between adjacent eaves beam sections and/or sill sections.

A second aspect of the present invention relates to conservatory roof constructions and is particularly concerned with the interconnection of frame components in angular relationship with one another.

Interconnection arrangements for this purpose are already known—see for example GB Patent No. 2323107 (Ultraframe (UK) Limited) and European Patent Application No. 945561 (Rickmans Limited), the disclosures of which provide background information relating to the types of conservatory roof constructions that the present invention is concerned with.

The present invention seeks to provide an improved arrangement for interconnection of a jack rafter to a main beam of a roof.

SUMMARY OF THE INVENTION

The first aspect of the present invention seeks to provide a conservatory design which eliminates the need for the production of mitred joints between sections of the eaves beam profiles and also affords significant flexibility in terms of the angles at which adjacent eaves beam sections may be interconnected.

According to first aspect of the present invention there is provided a conservatory framework comprising an eaves structure from which the roof is supported, at least one corner and/or in-line joint in the eaves structure being formed by a two part connector which interconnects adjacent sections of the eaves structure, the two parts being angularly adjustable relative to one another about an axis which is substantially perpendicular to the longitudinal axis or axes of the sections.

In this way, the need to mitre the profiled sections is eliminated. Instead, each profiled section may be cut substantially at right angles relative to the length of the section and the connector parts may be adjusted to accommodate the angle at which the profile sections are to be interconnected.

The framework structure typically includes a sill for mounting one or more window frames located below the eaves structure.

Each connector part may be arranged to interfit with each profiled section in such a way that the two components (connector part and section) are telescopically interconnected, e.g. so that one component inserts into the other. The connector parts may all be of substantially the same shape and configuration.

Each connector part may be provided with at least one projection arranged to be located in superimposed relation with a projection or projections of a like connector. The projection may be a lug. Each connector part may be provided with at least one lug arranged to be located in superimposed relation with a lug or lugs of the second connector. Each connector part may have at least two lugs and the connector parts may be arranged with their projections in interdigitated relation. The lugs may be apertured so that the connector parts can be coupled together by a pin or rod passing through aligned apertures in the lugs of adjacent connector parts.

The projections associated with each connector part may be offset in such a way that two substantially identical connector parts can be linked with one part in inverted relation with the other so that the main bodies of the two parts can be in alignment while the lugs are in superimposed relation.

One feature of the invention resides in the use of the connectors to locate load-transmitting members which serve to transmit the weight of the roof in such a way that the window frames in use are largely relieved from carrying the weight of the roof.

Another feature of the invention resides in the use of the eaves beam connectors to mount the glazing bars of the roof, e.g. for tilting adjustment according to the desired pitch of the roof.

The connector parts may locate a male or female component of a coupling for tiltably connecting a glazing bar to the eaves structure. The load-transmitting member and/or the male or female coupling component is may be located by said projections. The component is may be in the form of a channel for tiltably receiving a male part associated with a glazing bar.

The invention also resides in a connector assembly comprising first and second connector parts for telescopic connection with eaves beam sections of a roof, the connectors parts having interdigitating projections with aligned apertures receiving a pin or rod about which the connectors can be angularly adjusted, the arrangement being such that two substantially identical connector parts can be linked with one part in inverted relation with the other so that the main bodies of the two parts are in alignment while the projections are in interdigitated relation.

The pin or rod may be provided at its upper end with one component of a male-female coupling. The lower half of the pin or rod may be provided with means for transmitting load.

According to a second aspect of the present invention there is provided a framework comprising first and second elongate frame members which are coupled together in angular relation relative to one another by a coupling arrangement, the coupling arrangement comprising a plate with an upstanding pivot post, channel means associated with and extending longitudinally of the first frame member for receiving the plate and maintaining it captive against separation from the first member in a direction generally transverse to its elongation, and an arm adapted to be coupled to the pivot post and to the second frame member.

A coupling arrangement suitable for use in the above defined framework may have one or more of the following features either alone or in any combination where the context admits:

The channel means may have an opening from which the pivot post projects in a direction generally transverse to the elongation of the first member. At least one of the sides bounding the opening of the channel means may be provided with a groove for reception of the plate. The plate may be introduced into the channel means from one end of the first member and then adjusted by sliding it along the channel means to the desired location at which the second frame member is to be coupled to the first.

Alternatively, the plate may be so dimensioned that, in one orientation, it can be passed through the opening of the channel means and then turned about the axis of the pivot post to a second orientation in which it bridges the channel means and is trapped against withdrawal through the opening (unless returned to said one orientation). This has the advantage that the pivot post can be immediately located at any desired position without having to insert the plate at one end of the first frame member and then slide it lengthwise along the channel means.

The plate may co-operate with the channel means in such a way that, when turned from said one orientation, resistance to turning in the opposite direction is developed. For instance, the co-operation between the channel means and the plate may involve a wedging or binding action or an interference fit. For example, sides of the plate may be shaped or provided with formations so that, as the sides ride over the channel means during rotation from said one orientation to the trapped orientation, such shaping and/or formations engage with the channel means and a wedging, binding or other mechanism is obtained which resists turning of the plate in the reverse direction.

The plate may be provided with a restraining means such that when the plate is inserted into the channel and turned to the trapped orientation, movement of the plate in a vertical direction (i.e. along the axis of the pivot post) causes the restraining means to closely fit with the sides of the opening of the channel means, thereby preventing any further turning of the plate and restraining the plate in the desired position.

The restraining means may comprise at least one projection. The plate may be provided with a number of projections positioned in angularly spaced relation around the post so as to co-operate with at least one of the sides of the channel means to effect restraint. The projection may be a raised platform, at least one ridge, at least one stud, or combinations thereof.

The platform may have dimensions such that at least one of the sides of the platform closely engages with at least one of the sides of the opening of the channel means, thereby restraining the plate in the desired position. The platform may have non-circular dimensions, for example, it may be elliptical, rectangular or square. The pivot post may be mounted on the raised platform.

The at least one ridge may be positioned on the plate so as to closely engage with at least one of the sides of the channel means. The ridge may have non-circular dimensions, for example, it may be oval, rectangular or square.

The coupling means may include an elongated slot means in at least one of the arm and the second member and fastening means insertable through the slot means. The at least one slot means may be of curved configuration. The arm may be coupled in face to face relation with a vertically disposed flat wall of the jack rafter.

The frame members may be extrusions, e.g. of a metal such as aluminium or an alloy thereof or a plastics material.

The first frame member may be a hip frame member of a conservatory roof and the second frame member may be a jack rafter extending between the hip frame member and the eaves beam of the roof.

The framework may include means for coupling together the arm and the second frame member in such a way as to allow upward and downward tilting of the second member relative to the first member.

A coupling arrangement according to said second aspect of the invention, optionally including any one or more of features a)–p) is considered to constitute an invention in its own right but may, if desired, be used in combination with a framework according to said first aspect of the invention.

Another aspect of the present invention seeks to provide an improved panel end fitting for accommodating roofing panels of different thicknesses, the roofing panels, of polycarbonate, polyvinyl chloride or glass for example, being supported by glazing bars.

According to this aspect of the present invention there is provided a roofing structure comprising at least one roofing panel supported by glazing bars and an end fitting including a first portion underlying one end of the roofing panel and a second portion which overlies the panel, the first and second portions being separate from one another and being connectable together to allow panels of different thicknesses to be accommodated between them.

According to this aspect of the present invention there is provided an end fitting for use with a roofing panel supported by glazing bars, the fitting including a first portion being adapted in use to underlie one end of a roofing panel and a second portion which is adapted in use to overly the panel, the first and second portions being separate from one another and being connectable together to allow panels of different thicknesses to be accommodated between them.

The first and second portions may be connectable together via interfitting male and female formations which allow adjustment of the first and second portions to accommodate panels of different thicknesses. One of the first and second portions may be provided with an end stop for co-operation with the roofing panel to prevent the panel from sliding downwardly. The end stop may be constituted by one of the formations for connecting together the first and second portions.

The male and female formations may be connectable in such a way that they are rendered captive against withdrawal of one from the other once properly connected with the roofing panel located there between. In this way, the male and female formations may interconnect with each other in such a way as to resist subsequent separation of the second portion from the first portion so as to prevent a would-be intruder from gaining access to the inside of the conservatory by lifting roof panel and entering through the roof.

For the avoidance of doubt, the phrase "captive against withdrawal" is not to be interpreted in a strict literal sense irrespective of the force exerted in attempting to withdraw the male formation; rather it is to be interpreted as meaning that withdrawal is not possible without damaging one or other formation or both, e.g. to the extent that it is no longer possible to reassemble them together with the male formation held captive within the female formation.

The male and female formations may interconnect with a latching or ratchet-type action. In one embodiment of the invention, the male formation comprises a pair of divergent legs for reception within the female formation, the legs co-operating in ratchet-like fashion with the female formation.

To afford additional security, wedge means may be insertable into the space between the legs to prevent inward flexing of the legs and hence withdrawal from the female formation. The end fitting may be arranged to be tiltably connected to a support structure of the roof. The support structure may be an eaves structure or it may comprise a central support associated with a valley region of the roof.

A gasket or weatherstrip may be carried by the fitting to co-operate with the underside of the roofing panel. The gasket or weatherstrip may be located inwardly of the end stop. The fitting may be provided with a water drainage channel located outwardly of the gasket or weatherstrip.

The first portion may be connectable to the support structure in such a way that it cannot be withdrawn in a direction perpendicular to the longitudinal axis of the support structure. For example, the first portion may be provided with an enlarged head which is slidably received within a longitudinally extending channel associated with the support structure but cannot be withdrawn through the open mouth of the channel.

In another expression of this aspect of the invention, the first portion may be connectable by push-fit registry of co-operating locating portions associated with the first portion and the support structure, e.g. as disclosed in published UK Patent Application No. 2378207 and pending UK Patent Application No. 0130631.5, the disclosures of which are incorporated herein by this reference.

Thus, one locating portion may include a pair of oppositely directed wing portions which can deflect towards one another to allow insertion through an entry opening of the other locating portion but which restore once inserted and block withdrawal of said one locating portion. The blocking action may be implemented by co-operation between the free ends of the wing portions and the margins of the entry opening, e.g. in such a way as to prevent deflection of the wing portions towards each other.

Said one locating portion may be provided on the first portion of the end fitting while the other locating portion may provided on the support structure, or vice versa. The locating portions may be of generally part-circular configuration, one male and the other female, and the arrangement may be such that the male part forms a knuckle fitting within the female part which may be a socket associated with the eaves structure. The end fitting may be of a plastics material or it may of a metal or metal alloy particularly one which may be extruded, e.g. aluminium.

The top may be sealed by means of a sealing arrangement, for example, a seal may exist in the form of a co-extruded gasket such as that disclosed in GB2283997.

BRIEF DESCRIPTION OF THE DRAWINGS

The various aspects of the invention will now be described by way of example only with reference to the accompanying drawings, in which.

DETAILED DESCRIPTION OF THE PREFERRED EMBODIMENTS

Framework Connectors

Figure 1:
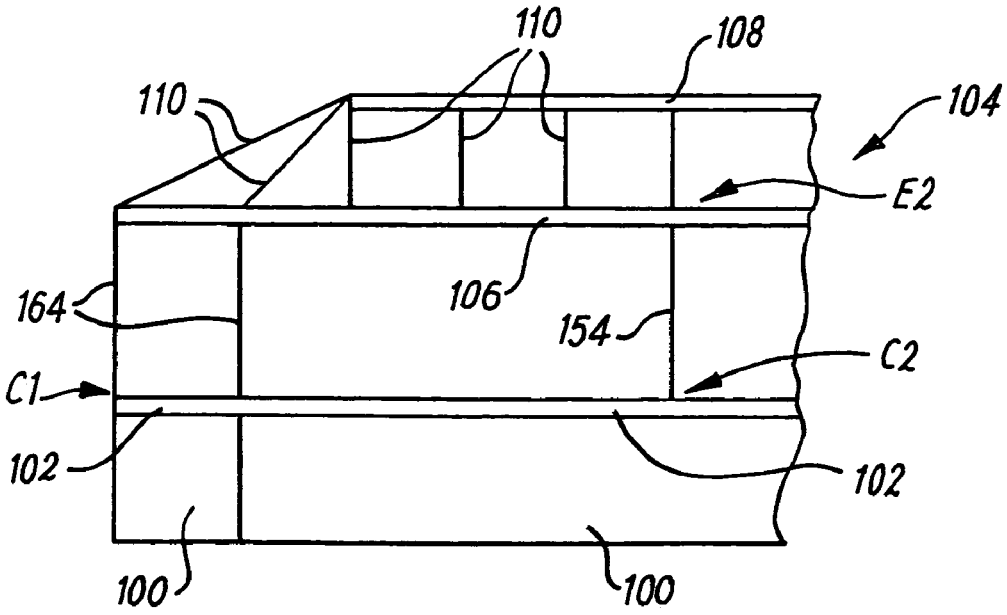
FIG. 1 is a diagrammatic line drawing showing part of a conservatory from a side elevation.
Figure 2:
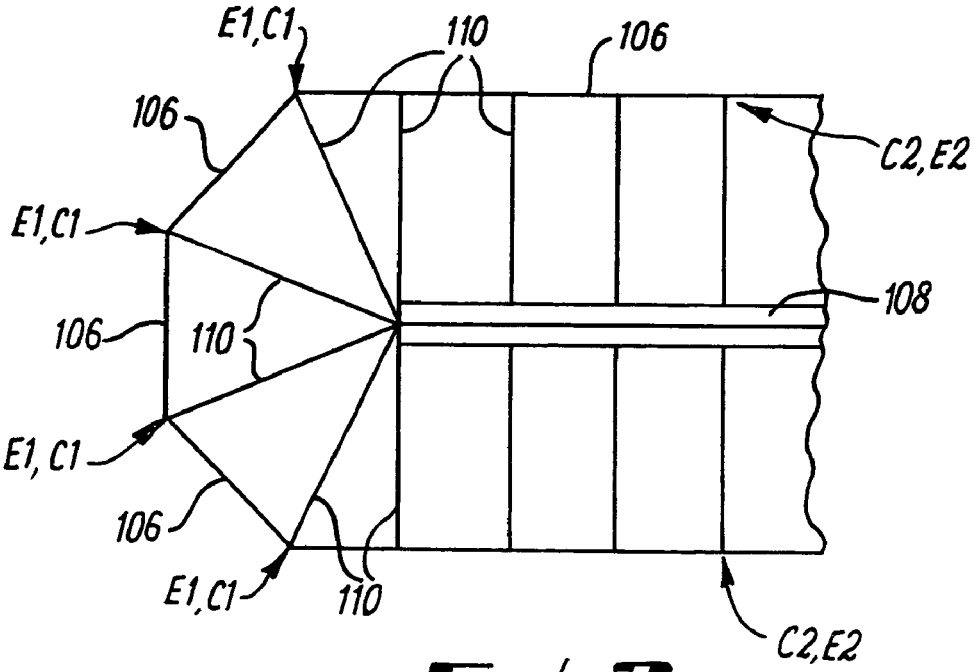
FIG. 2 is a corresponding plan view of the conservatory.

Referring firstly to FIGS. 1 and 2, a conservatory in accordance with a first aspect of the invention typically comprises a load-bearing wall 100 carrying a sill 102 above which a roof structure 104 is supported with glazed window frames (not shown) located between the sill 102 and an eaves beam 106 (also commonly referred to as the ring beam) of the roof structure. The roof structure comprises a ridge 108 and glazing bars 110 extending between the ridge 108 and sections of the eaves beam which extend around the sides of the conservatory. The glazing bars 110 serve to support roofing panels, e.g. of glass, polycarbonate or polyvinyl chloride, extending from the ridge 108 and overhanging the eaves beam sections 106. The eaves beam 106 and the sill 102 each comprise extruded profiles of for example aluminium or an aluminium alloy.

In the embodiment illustrated in FIGS. 1 and 2, the eaves beam and the sill are each made up of a number of sections cut from the respective extruded profiles and joints between adjacent sections are shown at locations E1, E2 and C1, C2, E1 and C1 being corner joints and E2 and C2 being intermediate joints between in-line sections of the extruded profiles. Typically, in a 3 segment-fronted conservatory design as shown in FIGS. 1 and 2, the internal angles at joints E1 and C1 will be about 135°. Where the design is a 5 segment-fronted conservatory, the internal angles at joints E1, C1 will be about or 150°. In a design such as that shown in FIG. 3, the eaves beam and sill joints may be of the in-line type corresponding to E2, C2 and the corner joints may be right angled.

Currently the practice is to produce the joints by mitring the adjacent sections of the extruded profiles forming the eaves beam and the sill, which is time consuming and requires a significant degree of accuracy in cutting if well-fitting joints are to be achieved. For this reason, the sections of the extruded profiles are usually cut to size and mitred off-site and then delivered to the construction site. Also, in current designs, the weight of the roof structure is largely transmitted from the eaves beam to the sill and hence to the load-bearing wall 100 through the glazed window frames which are often fabricated from extruded PVC profiles. A feature of the present invention allows for elimination of mitring of the adjacent sections of the extruded profiles by employing separate connectors which provide the corner joints or in-line joints of the eaves beam and "squaring off" the ends of the extruded profiles by cutting them substantially at right angles to the length of the profile. Another feature of the present invention allows significant latitude in the angles at the joints between the eaves beam sections.

The connectors between adjacent sections of the eaves beam may be designed for the purpose of controlling the load-bearing characteristics of the conservatory framework and, in particular, to ensure that the window frames are largely relieved of load-bearing duties so far as the weight of the roof structure is concerned. In particular, the connectors may be designed to co-operate with vertical load-transmitting members 164 which transmit the weight of the roof structure to the load-bearing wall 100 thereby substantially by-passing the window frames. These load-transmitting members 164 are primarily located at the corners of the conservatory framework but, particularly where the framework involves relatively long spans of the eaves beam with the attendant possibility of "sagging", they may also be located intermediate the corners by inclusion of the in-line connectors pairs in the eaves beam structure. In a modification, the load-transmitting members 164 may be arranged to transfer the weight of the roof directly to ground level rather than to the wall 100.

One example of a corner connector assembly for the joints E1 in the eaves beam structure is shown in FIGS. 3 to 7 and will be seen to comprise a pair of connectors 118 each comprising a main body 120 which is intended to fit in telescopic fashion with an eaves beam profile having a squared off end. For instance, the body 120 may be designed to be fit inside the eaves beam profile and it may be located by a shoulder or shoulders on the body which abut against the squared off end of the eaves beam section. Such an arrangement will be apparent in FIG. 6 where the part of the body 120 of each connector is received in the squared off eaves beam section 106 and part projects externally, there being a shoulder 121 abutting against the squared off end of the eaves beam section. Each connector 118 is provided with a number of lugs 122 which project from the body 120 and have aligned apertures 124. The connectors 118 may be manufactured as single piece mouldings of a plastics material having suitable properties in terms of for example ruggedness and strength for the intended application.

Figure 5:
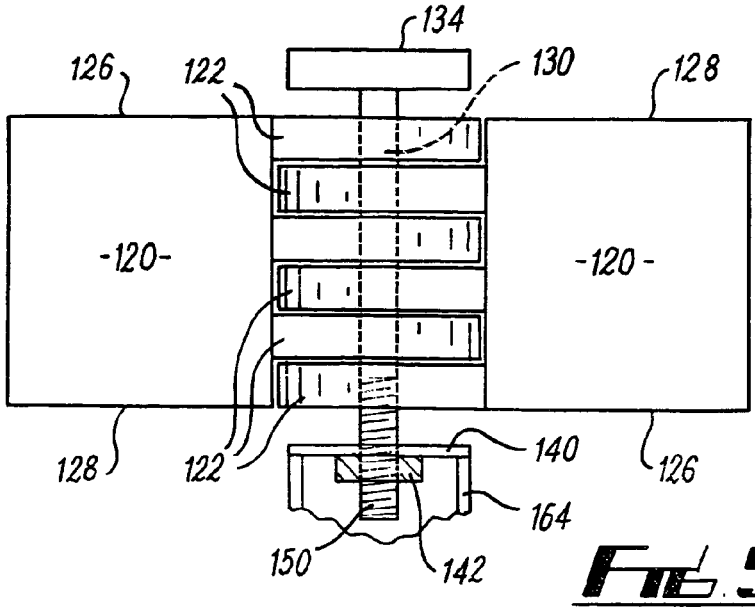
FIG. 5 is a side view showing the connectors assembled together with a glazing bar mount.
Figure 6:
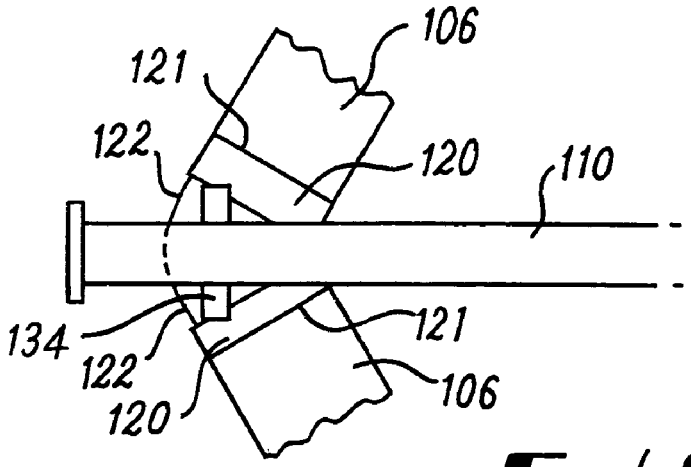
FIG. 6 is a plan view showing one corner of a conservatory roof employing the connectors of FIGS. 3 to 5.
Figure 7:
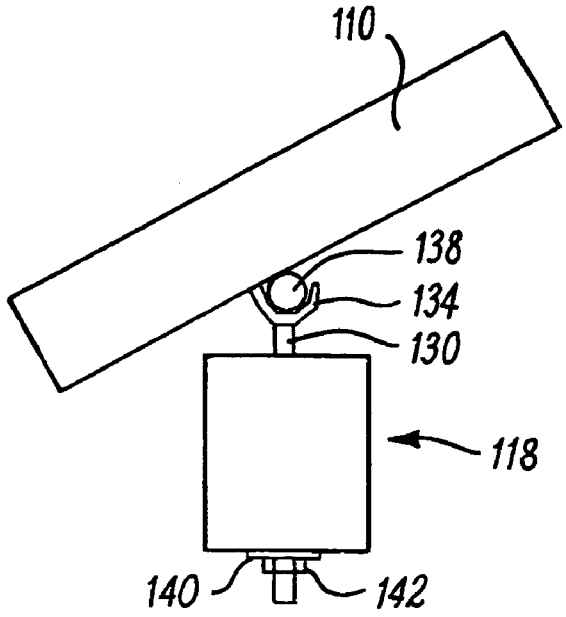
FIG. 7 is a side view showing the connector assembly and glazing bar mount in a glazing bar.

The lugs 122 are arranged in offset relation relative to the opposite faces 126, 128 of the body 120 so that the lugs 122 on one can be meshed or interdigitated with those on the other connector when the two connectors are brought together with one in inverted relation relative to the other as shown in FIG. 5. When so meshed, the lugs 122 can be arranged so that their apertures 124 are all aligned to receive a rod 130 (see FIG. 5) forming part of a device 132 which serves to mount glazing bars and/or to transmit load to the load-transmitting members 164 (see FIG. 1). When the connectors 118 are coupled together in this manner, it will been seen that they can be adjusted angularly relative to each other, for example to secure a joint angle of 135° or 150° or any other angle that may be required. Also, it will be appreciated that the connectors 118 may be used to interconnect in-line sections of the eaves beam (i.e. an angle of 180°).

The device 132 includes one half of a male-female coupling for connecting the lower end of a glazing bar 110 to the eaves beam. In the illustrated embodiment, the device 132 is provided with the female part of the coupling and is in the form of a channel 134 which can be oriented, e.g. by rotation of the rod 130, so that it is substantially perpendicular to the bisector 136 of the angle included between the connectors 118 (see FIG. 6). The channel 134 acts as a socket receiving a male part 138 associated with the glazing bar 110 so that the pitch of the glazing bar can be varied according to requirements by the tilting allowed by the male-female coupling between channel 134 and male part or spigot 138. The male part associated with the glazing bar may for instance form part of a tilting shoe device of the form disclosed in our prior UK Patent Application No. 0119048.7, the entire disclosure of which is incorporated herein by this reference, the tilting shoe device being fitted in telescopic relation with the lower end of the glazing bar 106.

Figure 3:
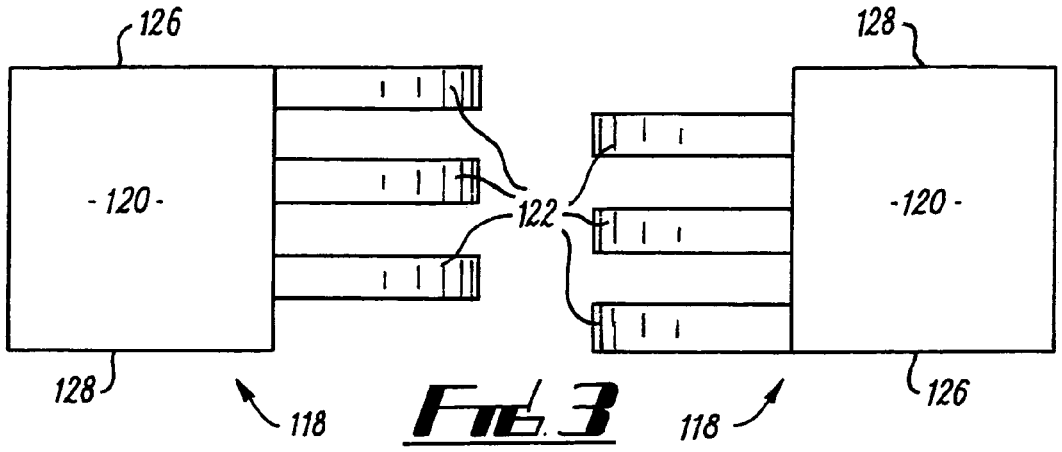
FIG. 3 is a side view of an assembly with the connectors shown separated.
Figure 4:
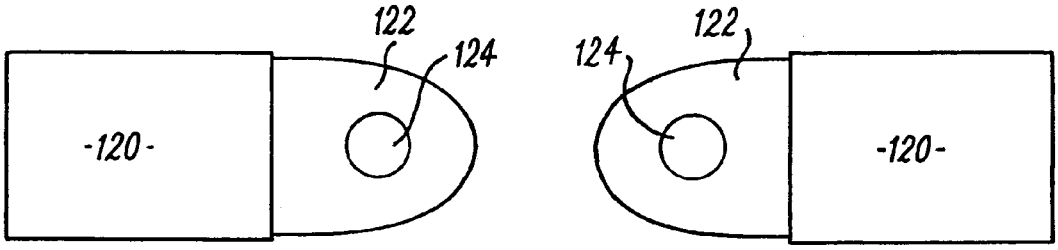
FIG. 4 is a plan view of the assembly showing the connectors separated.

The device 132 may also serve to transmit load to a load-transmitting member 164 which in turn may transmit the load exerted by the roof to the sill of the structure. The lower end of the rod 130 is arranged to be engaged with the upper end of the member 164 in order that load can be transmitted from the roof to the member 164. In FIG. 3, the connection is effected through a plate 140 which seats on and may be secured, e.g. by welding, to the upper end of the member 164, the plate 140 having a threaded connection with the lower end of the rod 130. The threaded connection may take the form of a threaded section 150 on the lower end of the rod 130 which engages in a nut 142 secured, e.g. by welding, to the underside of the plate 140. Although, in FIG. 5, a gap is present between the underside of the connectors 118 and the plate 140, in practice the connectors may seat on the plate 140.

Although in the illustrated embodiment, the device for coupling the glazing bar to the connectors allows the bar to be tiltably adjusted, we do not exclude the possibility that it may be such that the bar is mounted at a fixed angle of tilt.

Coupling Arrangements

Referring to FIGS. 8–17 of the drawings, which show two embodiments (FIGS. 8–12, 14, and FIGS. 13–17), in each embodiment the components 10 and 12 respectively constitute a hip bar and jack rafter forming part of a hipped conservatory roof. The hip bar 10 extends from the ridge (not shown) of the roof to the eaves beam while the jack rafter 12 extends between the hip bar 10 and the eaves beam (not shown). In practice, there may be a jack rafter extending from each side of a hip bar to the eaves beam.

Each component 10, 12 is formed as an extrusion and is of inverted T-shape comprising a central stem 14 with laterally projecting arms 16 on each side for use in supporting glazing or roofing sheets between the components. The upper ends of the stems 14 are adapted for use with cappings (not shown) which trap and effect sealing engagement with the sheets. In the case of the hip bar, the arms 16 include a base 18 and an upwardly directed wall 20 thereby forming a channel 22 on each side of the stem 14, the channel extending lengthwise of the extrusion and having an upwardly directed opening 24.

Figure 9:
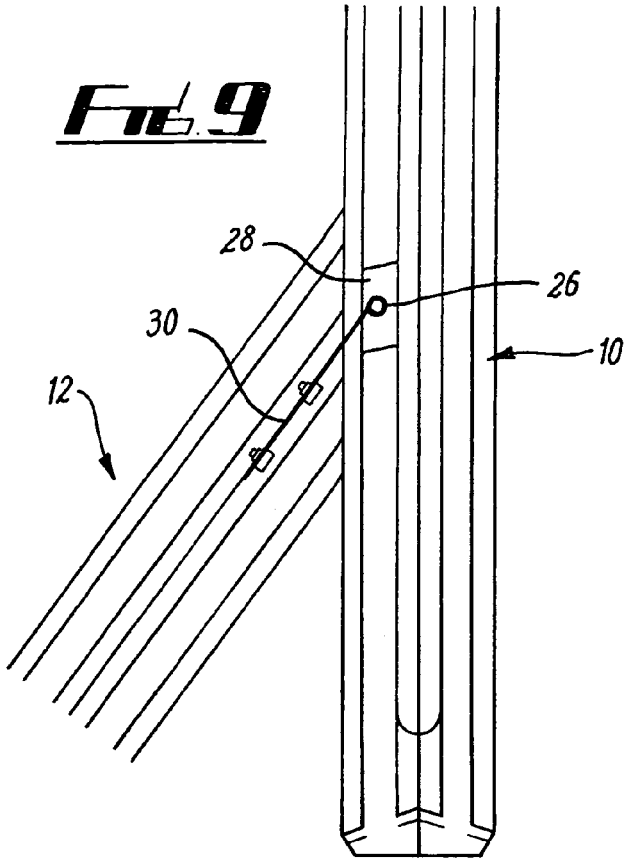
FIG. 9 is a plan view showing the jack rafter assembled to the hip bar.
Figure 10:
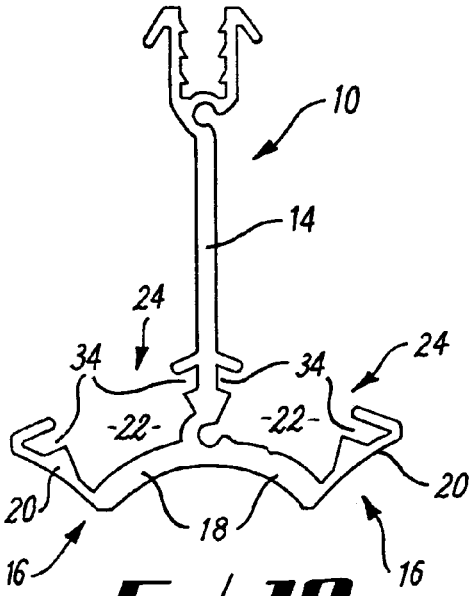
FIG. 10 is a sectional view of the hip bar.
Figure 11:
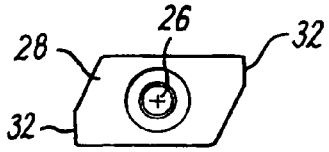
FIG. 11 is a plan view of the pivot post and plate unit.
Figure 12:
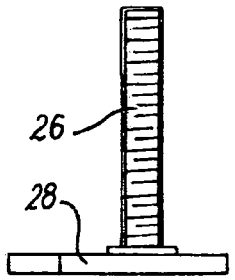
FIG. 12 is a slide elevation of the pivot post and plate unit.
Figure 13:
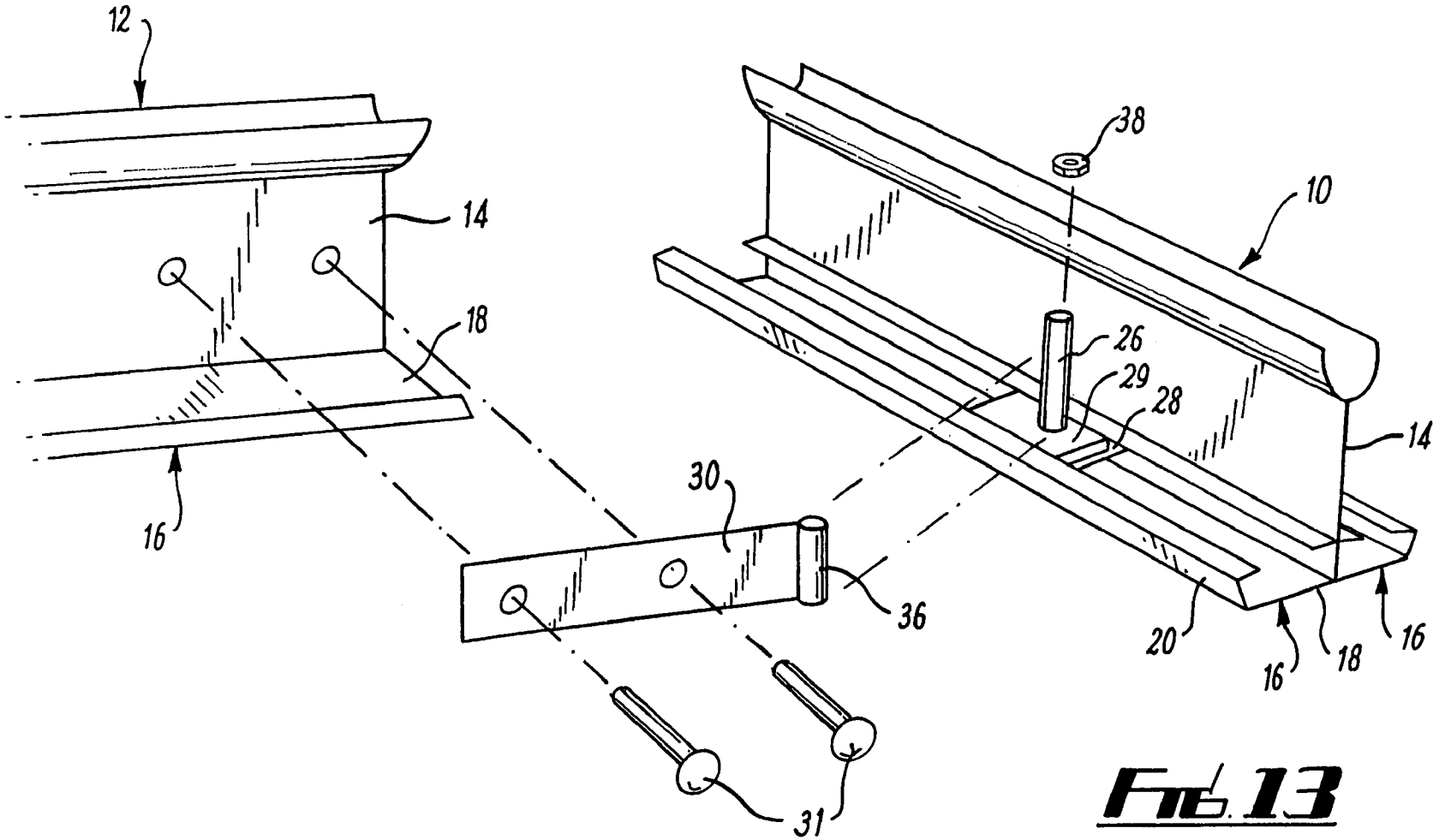
FIG. 13 is a schematic exploded view showing a hip bar, a jack rafter and a coupling arrangement in accordance with a second embodiment of the present invention.
Figure 14:
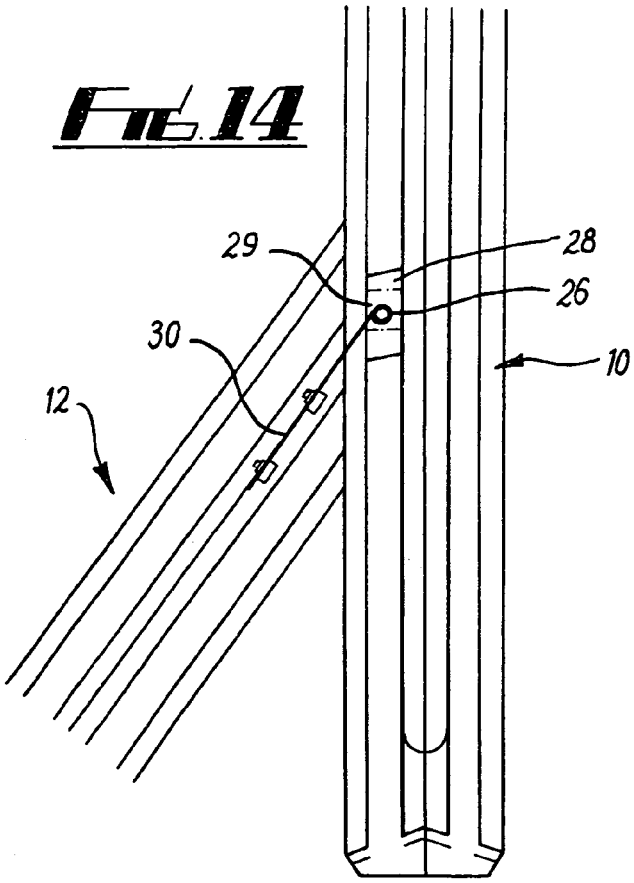
FIG. 14 is a plan view showing the jack rafter assembled to the hip bar in accordance with first and second embodiments of the present invention.
Figure 15:
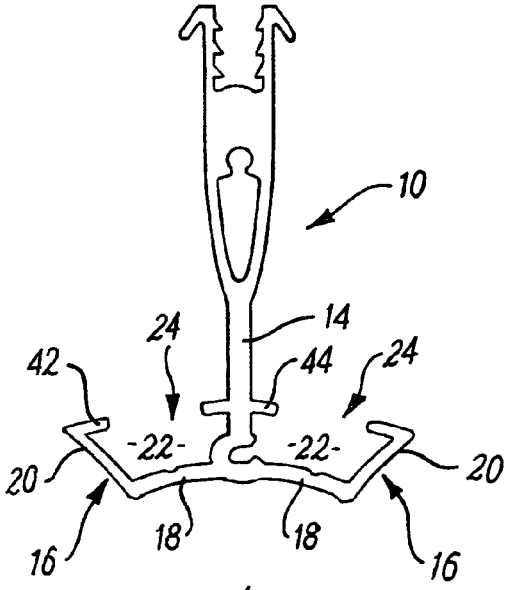
FIG. 15 is a sectional view of the hip bar in accordance with a second embodiment of the coupling arrangement.
Figure 16A:
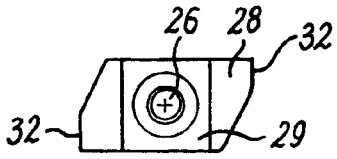
FIGS. 16A and 16B respectively show the pivot post and plate unit in plan view and side elevation in accordance with a second embodiment of the coupling arrangement.
Figure 16B:
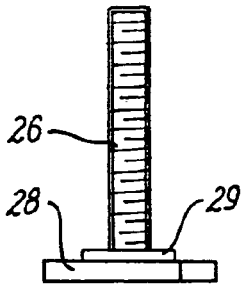
Figure 17C:
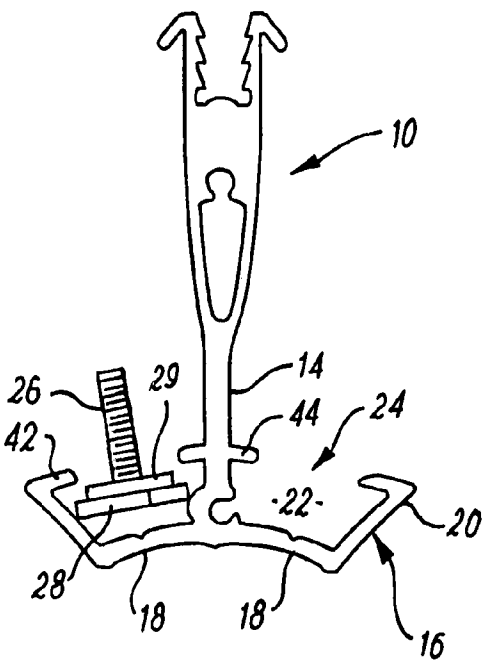
FIGS. 17A, B and C respectively illustrate successive stages in the assembly of the coupling arrangement with a glazing bar, according to said second embodiment.
Figure 17B:
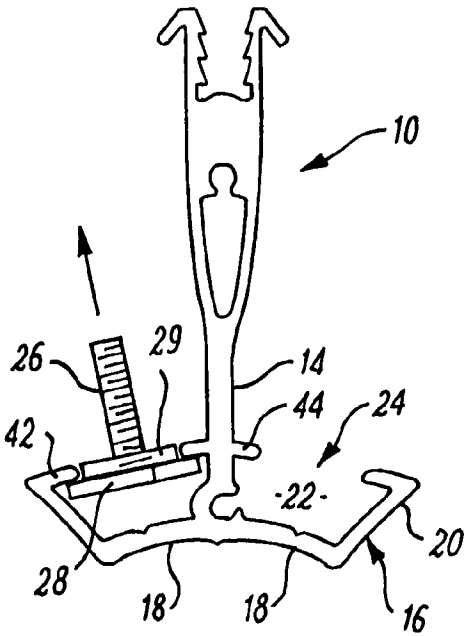
Figure 17A:
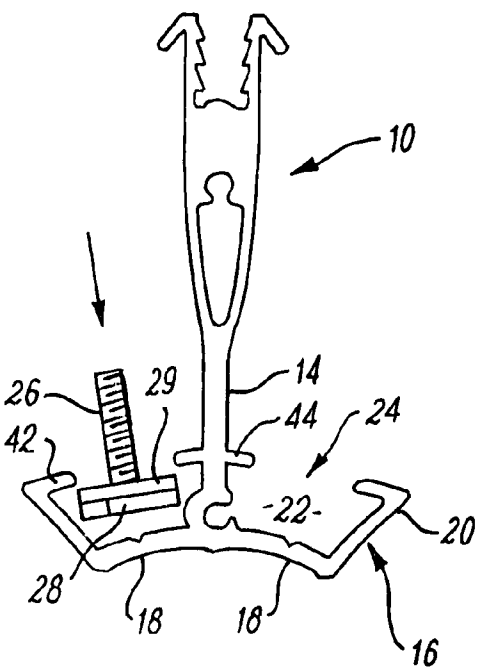

As shown in FIG. 9, the jack rafter 12 is connected to the hip bar 10 at an angle, the connection being made by means of a coupling arrangement comprising a pivot post 26 upstanding from a plate 28 and a pivot arm 30 which can swivel about the post 26 and is connected to the central stem 20 of the jack rafter 12 in face to face relation with the stem 20, e.g. by a suitable fastener or fasteners such as bolts 31 and associated nuts.

In the illustrated embodiments, the arm 30 is provided with circular holes for reception of the bolts or other fasteners. However, in practice, to allow the pitch of the jack rafter to be adjusted according to requirements, the holes in the arm and also holes in the central stem of the 14 the jack rafter may be elongated and possibly curved so that the jack rafter 12 can be tilted upwardly or downwardly to the appropriate pitch while the bolts are in place and then retained at the desired angle of pitch by operating the fastener(s) to firmly secure the arm to the stem 14. To this end, the elongated holes or slots in the arm may be generally transverse relative to those in the stem 20 of the jack rafter.

The pivot post 26 is located on the hip bar 10 by the plate 28 which is trapped in the channel 22. In the illustrated embodiments, the plate is of generally rectangular shape with one pair of sides longer than the other, the short dimension being such that the plate 28 can be introduced into the channel 22 through the opening 24. After registering the plate 28 within the channel 22, it can then be turned through about 90 degrees so that its long dimension more than bridges the opening 24 thereby rendering the plate 28 captive to the channel 22. In the first illustrated embodiment (FIGS. 8–12), the borders of the channel 22 are extruded with grooves 34 for locating the short sides of the plate 28.

When the plate 28 is received in this way within the channel 22, the pivot post 26 projects generally upwardly in a direction generally transverse to the elongation of the hip bar 10. To facilitate turning of the plate 28, its short sides are contoured in the manner shown in FIG. 11 so that it can be turned through 90 degrees until the portions 32 are substantially parallel with and proximate to the stem 14 and the wall 20. In this condition, the portions 22 may be sufficiently close to the stem and wall 20 that turning of the plate beyond 90 degrees is prevented.

The arm 30 is formed with a generally cylindrical sleeve 36 at one end for reception of the post 26. Means is provided for preventing lifting of the arm from the post, e.g. the post may be formed with a screw thread and a nut 38 may be provided for engagement with the thread to retain the arm 30 coupled to the post 26. The nut or other means may be used to fix or clamp the arm 30 in a desired angular relation when the appropriate positioning of the jack rafter has been obtained. The sense of the thread on the post may be such that tightening of the nut takes place in the same direction as turning of the plate 28 when moving it to the trapped position.

Figure 8:
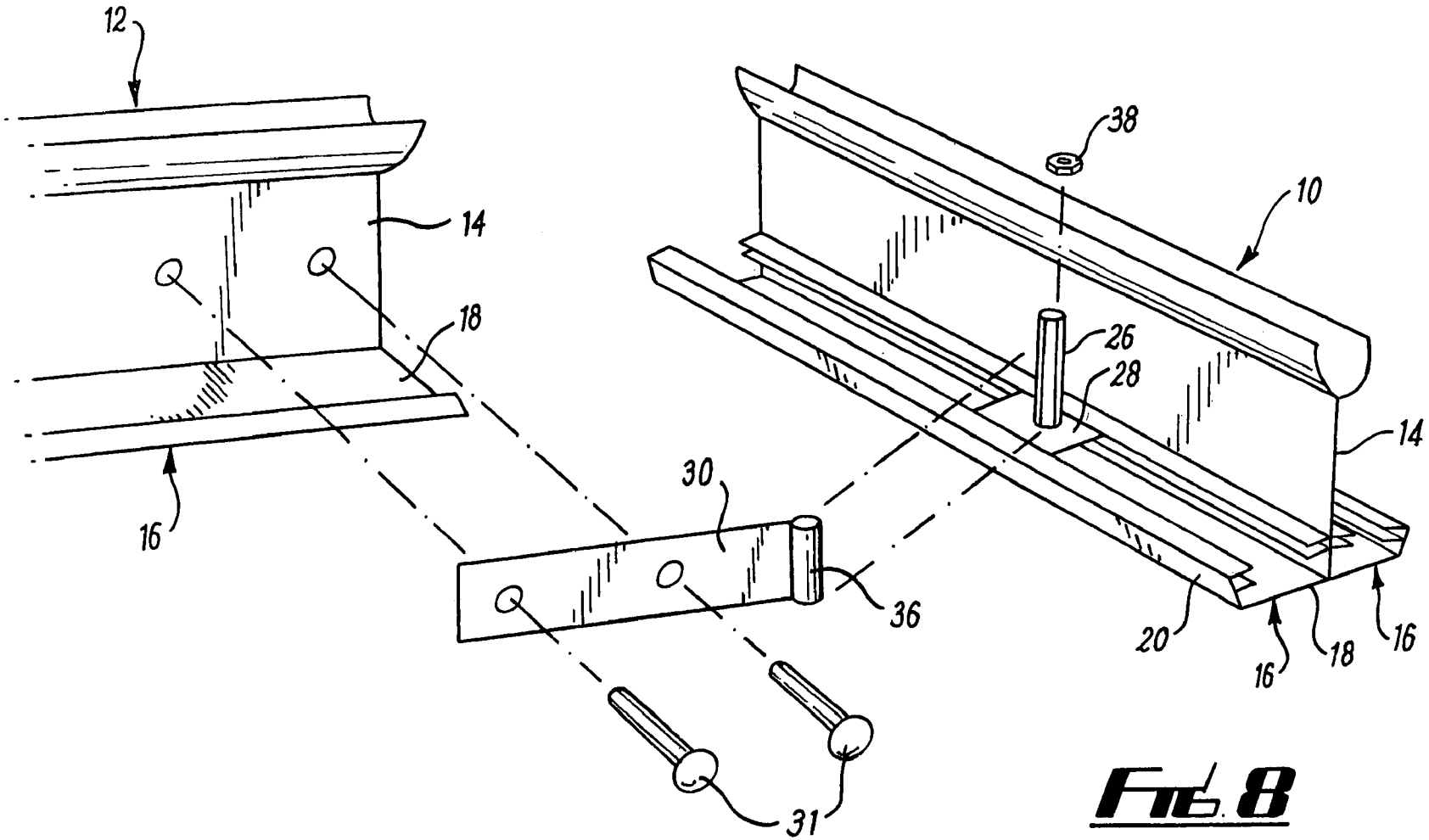
FIG. 8 is a schematic exploded view showing a hip bar, a jack rafter and a coupling arrangement in accordance with the present invention.

In order to reduce the relatively insignificant risk of the plate 28 becoming dislodged from the channel 22 as a result of somehow turning back in the reverse direction, it may be formed in such a way that a binding or wedging action is obtained during turning of the plate to the trapped orientation (FIG. 8). This may be achieved in various ways, e.g. by curling up the short edges of the plate so as to produce an interference fit within the grooves 34. Additionally or alternatively, the plate may be provided with formations such as teeth which "bite" into the material of the hip bar and resist or prevent turning of the plate in the reverse direction.

In the illustrated embodiments, the plate 28 is dimensioned so that it can be inserted through the openings 24 and then turned to render it captive to the hip bar. In a modification of the first embodiment, the plate may be insertable into the grooves 34 from one end of the hip bar and then adjusted to the desired position by sliding.

In the second illustrated embodiment (FIGS. 13–17), the plate 28 comprises restraining means 29, i.e. a generally square raised platform upon which the pivot post 26 is centrally mounted, the platform having dimensions which are substantially equal to the width of the opening 24. The plate is of generally rectangular shape with one pair of sides longer than the other, the short dimension being such that the plate 28 can be introduced into the channel 22 through the opening 24 (see FIG. 17A). After registering the plate 28 within the channel 22, it can then be turned through about 90 degrees so that the long dimension of the plate more than bridges the opening 24 (see FIG. 17B), and the sides of the platform 29 can fit closely with the sides of the channel 22. Tightening of a nut 38 onto the post 26 with the pivot arm 30 in place on the post 26 raises the plate until the sides of the platform 29 fit closely within the sides of the channel 22. At this point, the plate 28 engages the undersides of the flanges 42, 44 to render the coupling arrangement captive with the channel 22. Additionally, registration of the platform 29 as a close fit within the mouth of the channel restrains the plate 28 against rotation from the captive position (see FIG. 17C).

Although the second embodiment is illustrated with a platform 29 located on the plate 28, it will be understood that the restraining function of the platform 29 may be implemented in other ways. For example, there may be one or more projections provided on the same side of the plate as the post and so arranged that free entry of the coupling arrangement into the channel can be effected in one orientation of the coupling arrangement and the projection(s) block rotation of the plate 28 once the latter has been rotated into the captive position and the arrangement has been raised to register the projection(s) with the channel mouth.

Panel End Fittings

Figure 18:
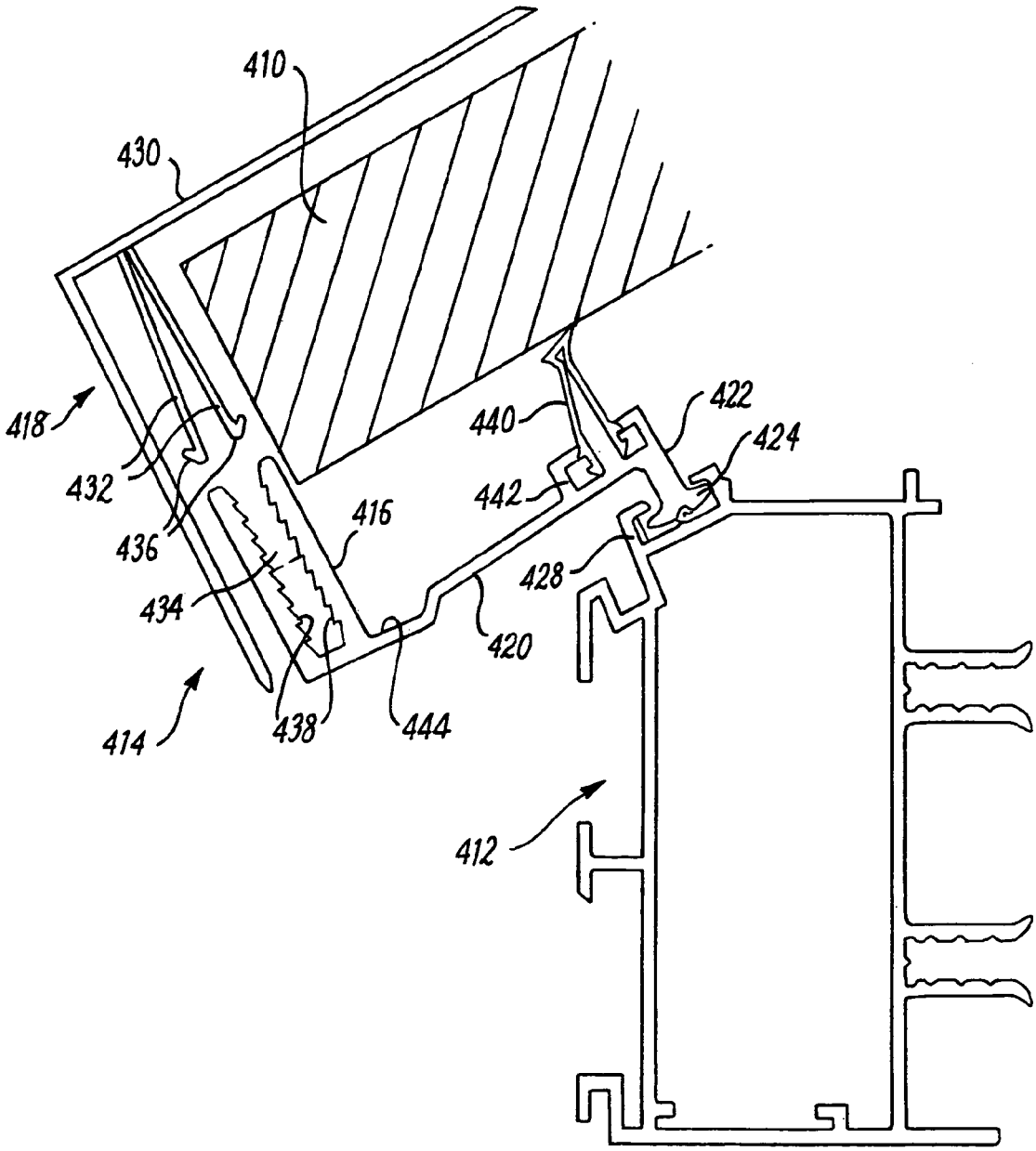
FIG. 18 is a sectional view through the eaves structure of a pitched conservatory roof, illustrating one form of roof panel end fitting.

Referring to FIG. 18, a pitched conservatory roof comprises a number of spaced glazing bars (not shown) between which polycarbonate or like roofing panels 410 are supported along their edges. The glazing bars extend between a ridge structure (not shown) and a box section eaves structure 412 which may be manufactured as an aluminium or aluminium alloy extrusion. The panels are supported with their ends overhanging, and in spaced relation with, the eaves structure 412 to drain into guttering (not shown). The eaves structure 412 surmounts a side of the conservatory.

Associated with the lower or forward ends of the panels 410 is a 2-part end fitting 414 which may be manufactured as a plastics extrusion or a metal extrusion such as an aluminium or aluminium alloy extrusion. Each end fitting 414 extends between a pair of adjacent, spaced apart glazing bars and has at its forward end an upwardly projecting end stop 416 for co-operation with the associated panel end and also with a separate panel end cover 418 of the fitting. The cover and the end stop are substantially co-extensive with the fitting 414 and extend between the adjacent glazing bars.

The fitting 414 includes a base 420 which extends beneath and in spaced relation with the underside of the panel 410.

At or adjacent its rearward edge, the fitting is provided with a downwardly directed projection 422 having a formation 424 for engagement with the eaves structure 412 in order to locate the end fitting. The nature of the engagement may be such that the fitting is able to tilt about the location of engagement in accordance with the intended pitch of the roof. In the illustrated embodiment, the engagement between the fitting 414 and the eaves structure 412 comprises interengageable male and female formations and to this end the formation 424 comprises an enlarged head which is trapped within a channel 428 which may be integral with the eaves structure 412. The head 424 and the channel 428 may be substantially co-extensive with the fitting in the lengthwise direction of the latter. The arrangement is such that the base of the fitting is assembled to the eaves structure by insertion of the formation 424 into the channel 428 at one end of the eaves structure and sliding the fitting lengthwise to the desired position. In this way, the fitting 414 is rendered captive to the eaves structure.

In a modification, instead of endwise/sliding engagement as shown in FIG. 18, the engagement between the fitting and the eaves structure may be via a push-fit arrangement as disclosed in published UK Patent Application No. 2378207 and pending UK Patent Application No. 0130631.5, the entire disclosures of which are incorporated herein by this reference.

The end stop 416 and the end cover 418 are arranged to be coupled together in such a way that the top wall 430 of the end cover can be brought into close overlying relation, e.g. contact with, the upper surface of the panel 410, while accommodating roof panels of different thicknesses, e.g. 25 mm and 35 mm. The cover 418 also includes a front wall which overlies the end of the roofing panel 410 and the end stop 416 so as to conceal them from view.

The coupling between the end stop 416 and the cover 418 may be such that, once engaged together, the end cover 418 is captive with the end stop and cannot be separated other than by use of force which results in breakage of one or both of the components. In the illustrated embodiment, the panel end cover 418 and the end stop 416 are provided with male and female formations 432, 434 which interfit with a latching or ratchet-type action. Thus, as shown, the male formation 432 may comprise a pair of divergent legs having lateral projections 436 which insert into a channel 434 having sawtooth-like projections 438 to provide a ratchet-type action which strongly resists withdrawal of the end cover 418 from the end stop 416 once the two components have been engaged with each other.

It will be understood that the formations 432, 434 will be designed to allow the extent of insertion of the legs 432 into the channel 432 to such an extent as to accommodate both 35 mm and 25 mm panel thicknesses. To increase the resistance to withdrawal of the end cover 418 from the end stop 416, a wedge may be provided for insertion into the channel 432 so as to be received between the legs 432 thereby blocking inward flexing of the same and preventing return movement of the legs out of the channel 434. Differently dimensioned wedges may be employed according to the thickness of the roofing panel to be accommodated.

The gap between the base 420 of the fitting and the underside face of the panel is bridged by a weatherstrip or gasket 440 which is separate from the fitting 414 and is engaged with the fitting at a suitable location, e.g. channel 442 as illustrated. To aid drainage of any water collecting within the fitting, the base 420 is configured with a channel 444 for collection of any water so that the water can flow lengthwise of the fitting (and the eaves structure) to a suitable collection point.

Figure 19:
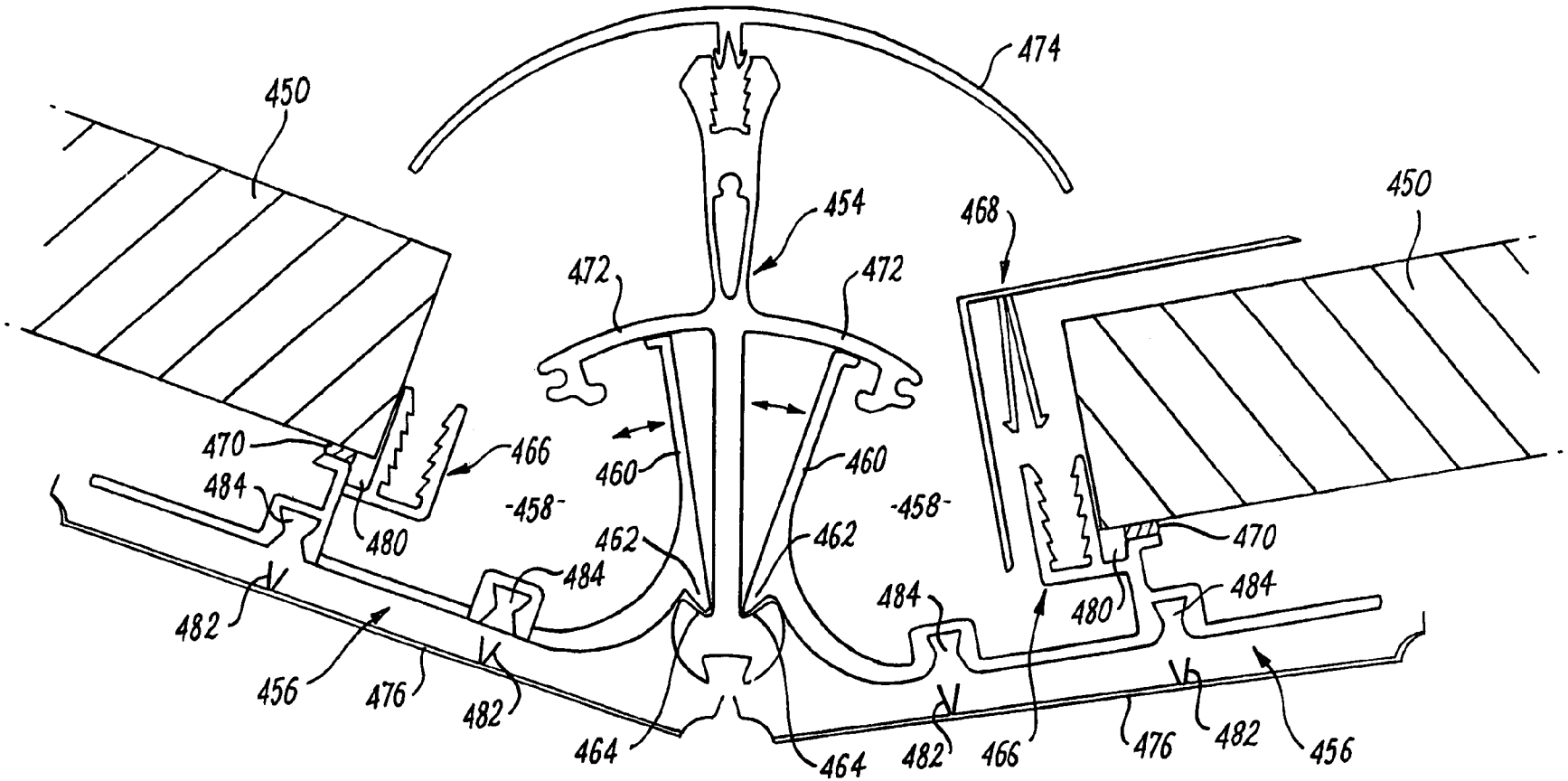
FIG. 19 is a sectional view illustrating a second form of end fitting suitable for use in a valley region of a conservatory roof.

Referring now to FIG. 19, a pair of sloping roofing panels 450 (supported along their long edges by unshown glazing bars) terminate in the vicinity of a valley region of a conservatory roof construction. The valley includes a central support 454 such as an aluminium extrusion, the long axis of which extends perpendicularly to the plane of the paper. End fittings 456 are tiltably mounted one on each side of the central support to allow the pitch to be adjusted according to requirements. Each end fitting 456 comprises a base which projects forwardly of the associated panel end and has an upturned section 460 to form a gulley 458 in which water from the associated panel can be collected. The upturned sections 460 include fulcrum formations 462 for engagement with locating grooves 464 on the central support 454 to allow tilting as described above.

Each fitting 456 is provided with an end stop 466 for co-operation with the associated panel end and also with an end cover 468 of the fitting in the manner described above with reference to FIG. 18 so as accommodate roofing panels of different thicknesses. In FIG. 19 only one end cover 468 is illustrated but it will be appreciated that each end fitting will include an end cover 468 in practice. A gasket or weatherstrip 470 is provided for making sealing contact with the underside of the panel 450. The gap between end cover 468 and roofing panel 450 is sealed with a sealing arrangement (not shown) to prevent ingress of water.

The gap between the adjacent upturned sections 460 of the fittings is bridged by curved sections 472 which may be integral with the central support and are arranged so as not to impede tilting of the fittings 456. Capping 474 is provided at the upper end of the central support and covers 476 are provided for coupling to the undersides of the fittings 456 by co-operating formations 482, 484. In FIG. 19, the covers 476 are shown prior to fitting to the fittings 456. Each fitting may be extruded with a water drainage channel 480 extending lengthwise of the fitting and located outwardly of the gasket or weatherstrip 470. As in the embodiment of FIG. 18, the components 456, 458 of the end fittings illustrated in FIG. 19 may be produced as plastics or metal (e.g. aluminium) extrusions.

Whilst endeavouring in the foregoing specification to draw attention to those features of the invention believed to be of particular importance, it should be understood that the Applicant claims protection in respect of any patentable feature or combination of features disclosed herein and/or shown in the drawings whether or not particular emphasis has been placed on such feature or features.

The invention claimed is:

1. A conservatory framework comprising an eaves structure from which a roof is supported, a joint in the eaves structure formed by two substantially identical connector parts which interconnect adjacent profiled sections of the eaves structure, the connector parts having interdigitating projections with aligned apertures receiving a pin or rod about which the connector parts are angularly adjustable relative to one another, the connector parts being linkable with one connector part in inverted relation with the other so that main bodies of the two connector parts are in alignment while the projections are in interdigitated relation; and a sill for mounting one or more window frames located below the eaves structure.

2. A framework as claimed in claim 1 in which each connector part is arranged to interfit with each profiled section in such a way that each connector part is telescopically interconnected with one of the profiled sections.

3. A framework as claimed in claim 1 in which each each projection of one of the connector parts is arranged to be located in superimposed relation with at least one of the projections of another of the other connector part.

4. A framework as claimed in claim 1 in which the connector parts locate a load-transmitting member.

5. A framework as claimed in claim 4 in which the load-transmitting member serves to transmit the weight of the roof to a location such that the window frame in use is largely relieved from carrying the weight of the roof.

6. A framework as claimed in claim 5 in which the pin or rod is provided with said load-transmitting member.

7. A connector assembly comprising first and second substantially identical connector parts for telescopic connection with eaves beam sections of a roof, the connector parts having interdigitating projections with aligned apertures receiving a pin or rod about which the connector parts are angularly adjustable, the arrangement being such the connector parts are linkable with one connector part in inverted relation with the other so that the main bodies of the two connector parts are in alignment while the projections are in interdigitated relation.

8. A connector assembly as claimed in claim 7 including at least one glazing bar forming part of the roof of the conservatory framework and mounted by said connector assembly.

9. A connector assembly as claimed in claim 8 in which the glazing bar is mounted tiltably by said connector assembly.

10. A connector assembly as claimed in claim 8 in which the connector assembly is provided with a male or female coupling component which mounts said glazing bar.

11. A connector assembly as claimed in claim 10 in which the pin or rod is provided with said coupling component.

12. A framework comprising first and second elongate frame members which are coupled together in angular relation relative to one another by a coupling arrangement, the coupling arrangement comprising a plate with an upstanding pivot post, a channel associated with and extending longitudinally of the first frame member for receiving the plate and maintaining it captive against separation from the first member in a direction generally transverse to its elongation, and an arm adapted to be coupled to the pivot post and to the second frame member; wherein the plate is so dimensioned that, in one orientation, it is insertable through the opening of the channel and turnable about the axis of the pivot post to a second orientation in which it bridges the channel and is trapped against withdrawal through the opening.

13. A framework as claimed in claim 12 in which the channel has an opening from which the pivot post projects in a direction generally transverse to the elongation of the first member.

14. A framework as claimed in claim 12 in which the plate co-operates with the channel in such a way that, when turned from said one orientation, resistance to turning in the opposite direction is developed.

15. A framework as claimed in claim 12 in which the plate comprises a restrainer to engage with the sides of the opening of the channel to prevent movement of the plate from its captive position.

16. A framework as claimed in claim 12, the restrainer comprising a projection or projections located on the same side of the plate as the post.

17. A framework as claimed in claim 12 in which the first frame member is a hip frame member of a conservatory roof and the second frame member is a jack rafter extending between the hip frame member and the eaves beam of the roof.

* * * * *